US007862208B2

(12) United States Patent
Melzner

(10) Patent No.: US 7,862,208 B2
(45) Date of Patent: Jan. 4, 2011

(54) DIMMING DEVICE FOR A SEARCHLIGHT

(75) Inventor: Erwin Melzner, Frasdorf (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 240 days.

(21) Appl. No.: 12/226,811

(22) PCT Filed: Apr. 23, 2007

(86) PCT No.: PCT/EP2007/003732

§ 371 (c)(1),
(2), (4) Date: Oct. 28, 2008

(87) PCT Pub. No.: WO2007/124922

PCT Pub. Date: Nov. 8, 2007

(65) Prior Publication Data

US 2009/0073696 A1 Mar. 19, 2009

(30) Foreign Application Priority Data

Apr. 28, 2006 (DE) ..... 20 2006 007 227

(51) Int. Cl.
*F21V 14/08* (2006.01)
*F21V 11/06* (2006.01)

(52) U.S. Cl. ..... 362/279; 362/281; 362/283; 362/284; 362/319; 362/322

(58) Field of Classification Search ..... 362/279, 362/281, 283, 284, 319, 322
See application file for complete search history.

(56) References Cited

U.S. PATENT DOCUMENTS 2,424,575 A * 7/1947 Aves ..... 362/281
2,705,318 A * 3/1955 Hallerberg ..... 340/815.5
4,037,097 A 7/1977 Stillman et al.
4,797,795 A 1/1989 Callahan
4,800,474 A * 1/1989 Bornhorst ..... 362/293
5,113,332 A 5/1992 Richardson (Continued)

FOREIGN PATENT DOCUMENTS

AT 367 887 12/1978

(Continued)

OTHER PUBLICATIONS

English translation of International Preliminary Report on Patentability dated Dec. 24, 2008 for corresponding PCT application No. PCT/EP2007/003732.
International Search Report, dated Aug. 14, 2007, corresponding to PCT/EP2007/003732.
International Preliminary Examination Report, dated Aug. 28, 2008, corresponding to PCT/EP2007/003732.

*Primary Examiner*—Stephen F Husar
*Assistant Examiner*—James W Cranson
(74) *Attorney, Agent, or Firm*—Christie, Parker & Hale LLP

(57) ABSTRACT

A dimming device for a searchlight for adjusting the brightness of a light field generated by a searchlight is provided. The dimming device comprising a plurality of different screening elements, which are formed and provided to partly or completely screen the light emitted by the searchlight. The screening elements are formed by different structured masks at least partly screening the light emitted by the searchlight, which include regularly arranged opaque or partly transparent regions and transparent regions. Means each are provided for incremental adjustment of the brightness of the generated light field of the searchlight either to bring the screening elements into the region of the light emitted by the searchlight, in order to reduce the brightness of the light field generated by one brightness level, or to remove the same from the region of the light emitted by the searchlight, in order to increase the brightness of the light field generated by one brightness level.

27 Claims, 8 Drawing Sheets

U.S. PATENT DOCUMENTS

| | | | | |
|---|---|---|---|---|
| 5,258,895 | A | 11/1993 | Bosse | |
| 6,076,942 | A | 6/2000 | Brandt | |
| 6,796,682 | B2 * | 9/2004 | Hough et al. | 362/268 |
| 7,331,692 | B2 * | 2/2008 | Baiardi et al. | 362/322 |
| 7,736,025 | B2 * | 6/2010 | Hofmann et al. | 362/293 |
| 2004/0037082 | A1 | 2/2004 | Schmidt | |

FOREIGN PATENT DOCUMENTS

| | | | |
|---|---|---|---|
| DE | 83 03 602.4 | | 12/1978 |
| DE | G 83 03 602.4 | | 7/1984 |
| DE | 197 40 592 | A1 | 3/1999 |
| DE | 299 16 992 | U1 | 1/2000 |
| DE | 199 46 015 | A1 | 4/2001 |
| DE | 202 00 680 | U1 | 6/2002 |
| DE | 202 15 365 | U1 | 3/2004 |
| EP | 0 017 210 | A1 | 10/1980 |
| EP | 0 854 319 | A1 | 7/1998 |
| EP | 1 331 437 | A1 | 7/2003 |
| EP | 1 635 207 | A2 | 3/2006 |
| EP | 1 645 796 | A2 | 4/2006 |
| GB | 1 603 529 | | 11/1981 |

* cited by examiner

FIG 4A

| number of screening elements | possible conditions | smallest brightness level | greatest screening factor | screening element 1st | 2nd | 3rd | 4th | 5th | 6th |
|---|---|---|---|---|---|---|---|---|---|
| 1 | 2 | 1/2 | 1/2 | 1/2 | | | | | |
| 2 | 4 | 1/4 | 3/4 | 1/4 | 1/2 | | | | |
| 3 | 8 | 1/8 | 7/8 | 1/8 | 1/4 | 1/2 | | | |
| 4 | 16 | 1/16 | 15/16 | 1/16 | 1/8 | 1/4 | 1/2 | | |
| 5 | 32 | 1/32 | 31/32 | 1/32 | 1/16 | 1/8 | 1/4 | 1/2 | |
| 6 | 64 | 1/64 | 63/64 | 1/64 | 1/32 | 1/16 | 1/8 | 1/4 | 1/2 |

FIG 4B

| number of screening elements | possible conditions | smallest brightness level | greatest screening factor | screening element 1st | 2nd | 3rd | 4th | 5th | 6th |
|---|---|---|---|---|---|---|---|---|---|
| 1 | 2 | 1 | 1 | 1 | | | | | |
| 2 | 4 | 1/3 | 1 | 1/3 | 2/3 | | | | |
| 3 | 5 | 1/4 | 1 | 1/4 | 1/4 | 1/2 | | | |
| 4 | 9 | 1/8 | 1 | 1/8 | 1/8 | 1/4 | 1/2 | | |
| 5 | 17 | 1/16 | 1 | 1/16 | 1/16 | 1/8 | 1/4 | 1/2 | |
| 6 | 33 | 1/32 | 1 | 1/32 | 1/32 | 1/16 | 1/8 | 1/4 | 1/2 |

FIG 6

| Brightness level | 1 | 2 | 3 | 4 | 5 | 6 | 7 | 8 | 9 |
|---|---|---|---|---|---|---|---|---|---|
| Screening factor | 0 | 1/8 | 1/4 | 3/8 | 1/2 | 5/8 | 3/4 | 7/8 | 1.00 |
| Transmission | 1 | 7/8 | 3/4 | 5/8 | 1/2 | 3/8 | 1/4 | 1/8 | 0.00 |
| Screening element 22A' | | X | (X) | (X) | (X) | (X) | (X) | (X) | (X) |
| Screening element 22B' | | | X | | X | | X | | X |
| Screening element 22C' | | | | X | X | | | X | X |
| Screening element 22D' | | | | | | X | X | X | X |

DIMMING DEVICE FOR A SEARCHLIGHT

CROSS-REFERENCE TO A RELATED APPLICATION

This application is a National Phase Patent Application of International Patent Application No. PCT/EP2007/003732, filed on Apr. 23, 2007, which claims priority of German Utility Model Application No. 20 2006 007 227.6, filed on Apr. 28, 2006.

BACKGROUND

This invention relates to a dimming device and a searchlight with a dimming device.

Such dimming device serves to mechanically dim the brightness of a light field generated by a searchlight, in order to adjust and possibly reduce the brightness of the light field, and for this purpose includes one or more screening elements adapted to at least partly screen the light emitted by the searchlight. Such dimming devices are used in particular in high-performance searchlights, which can for instance constitute daylight searchlights or ceramic searchlights, in order to adjust the brightness of the light field generated, and are advantageous for instance as compared to presently known electronic ballasts, which only to a restricted extent can be used for dimming high-performance searchlights, since they influence the operating behavior of such searchlights and change the color temperature of a searchlight when dimming the same. Therefore, known electronic ballasts only provide for dimming in a very limited dimming range or do not provide for dimming at all.

In particular in television studios, however, it is absolutely necessary to provide for dimming in a dimming range between 0% (no dimming) and 100% (complete darkening) with a homogeneous distribution of light, so as to be able to reproducibly adjust a certain light field.

From DE 299 16 992 U1, a mechanical dimming device in the form of an adjustable multiflap shutter for lighting equipment, in particular for studio searchlights, is known, in which a number of lamellae are rotatably mounted in a frame. By means of a manually or power-operable adjusting mechanism, the lamellae can be moved here between a completely closed position of the multiflap shutter, in which the edge portions of the lamellae overlappingly lie one above the other, up to a completely open position, in which the lamellae are aligned vertical to the front disk of the searchlight. With a constant luminous intensity of the searchlight, the brightness of the light field generated hence can be adjusted from zero with completely closed lamellae to almost the full luminous intensity emitted by the lamp with open lamellae, due to the angular adjustment of the lamellae. The lamella system can be formed either with parallel lamellae or with lamellae arranged radially with respect to each other, which lamellae can be provided with a ceramic coating, in order to prevent a deformation of the lamellae due to the heat produced also in the case of high-performance searchlights.

Such dimming devices constituting multiflap shutters can lead to an undesirable influence on the light field generated by the searchlight. In particular, such multiflap shutters allow a stepless dimming of the brightness of the light field generated, but they cause irregularities, for instance in the form of strip patterns, in the light field generated, which also are dependent on the focus adjustment of the searchlight. Since the multiflap shutters in addition include supporting structures in the form of webs or axles for holding the lamellae and the lamellae are changed in terms of their alignment, but are not removed from the region of the light emitted by the searchlight, a complete brightening, i.e. a light field with the maximum luminous intensity produced by the searchlight, is not possible. If finer lamellae are used, the strip patterns in the light field can be reduced, but due to the required greater number of lamellae, the maximum adjustable brightness is further reduced.

Other dimming devices, also referred to as "stepped density filter" and "variable density filter", employ screening elements for instance in the form of optical wedges arranged on a glass disk, which are tapered in one direction and for dimming a searchlight are shifted into the region of the emitted light such that for adjusting a great brightness, the narrow portions of the optical wedges are positioned in the region of the light, and for adjusting a small brightness, the wide portions of the optical wedges are shifted into the emitted light, so as to achieve on the one hand a weak screening and on the other hand a strong screening of the light. Such screening elements can constitute, for instance, rectangular plates movable relative to a searchlight or circular elements rotatable relative to the searchlight, with the brightness being adjusted by a change in position of the screening element relative to the searchlight. Furthermore, instead of the optical wedges, a continuously changing grey distribution can also be provided on such screening elements. In such dimming devices, it is disadvantageous that the screening element used must be formed at least twice as wide and high as the light outlet opening of the searchlight—preferably even greater by a multiple—for adjusting a neat light distribution in the light field.

From DE 199 46 015 A1, a dimming device is known, in which for adjusting the brightness of a light field generated by a searchlight two perforated grids are used, which are shifted relative to each other for regulating the brightness of the light field. In this way, a stepless adjustment of the brightness of the light field is possible, wherein the brightness can, however, only be regulated within a very small range and cannot be darkened completely.

U.S. Pat. No. 4,037,097 relates to a slide changer for a lighting system for replacing filters or also mechanical dimmers, which includes a housing enclosing a plurality of disks and a mechanical swinging means. By the swinging means, the slides are moved before the lightfield of a spotlight or removed from the light field as desired.

EP 0 017 210 A discloses a searchlight, which in a searchlight housing includes an arrangement for holding a lens and a shutter holding device. The shutters can be moved from outside by means of handles and be adjusted in their position.

From U.S. Pat. No. 6,076,942 an arrangement for generating a homogeneous light field of uniform intensity is known, in particular for checking solar panels. For this purpose, filters are mounted on holding devices in a light beam, which consist of a number of mounted wires and influence the light emitted by a lamp.

From U.S. Pat. No. 5,258,895 a device for generating a moire effect is known, in which patterned masks are moved into a light beam for producing the effects.

The same is true for U.S. Pat. No. 4,797,795,from which a lighting device is known, in which different light parameters can be adapted in an automatic and variable way and which in particular relates to the control of such lighting device.

EP 1 331 437 finally discloses a light radiator, which includes, however, no means for variably screening and dimming.

SUMMARY

It is the object underlying the present invention to provide a dimming device and a searchlight with a dimming device, which allow an adjustment of the brightness of the light field generated in a wide range with a minimum influence on the light distribution in the light field and a compact construction.

The dimming device of an exemplary embodiment of the invention thus includes a plurality of screening elements, which are provided in the form of structured masks, which for regulating the brightness of the light field generated are brought into the region of the light emitted by the searchlight or are removed from the region of the light. Moving the mask into the light emitted by the searchlight or removing the mask from the emitted light allows an incremental adjustment of the brightness of the light field, in that the light either is at least partly screened by the mask or, when the mask is not within the region of the emitted light, is transmitted unchanged. Here, it is essential that the adjustment of the brightness is not effected by a variation of the effective cross-section of the mask, like for instance when swinging the lamellae, but by either completely introducing the mask into the emitted light, in order to influence the light, or completely removing the same from the region of the light, in order to let the light pass unchanged.

The dimming device includes a plurality of different screening elements, which each form different masks for adjusting the brightness levels of the light field generated. By superposition of the different screening elements, different brightness levels of the light field generated can then be adjusted, wherein each screening element is described by a screening factor, which is determined by the area ratio of opaque regions of the mask to the entire surface of the mask, and hence indicates the ratio of screened light to the entire light impinging on the mask.

A fundamental idea here consists in that by digitally superimposing different masks, different brightness levels can be adjusted. By combining the screening elements which constitute masks, the screening effected by the screening elements then can be varied incrementally, with this variation being effected incrementally by adding or removing one or more screening elements. The screening adjusted by the combination and superposition of the screening elements for adjusting the brightness of the light field here can be described by a total screening factor of the superimposed screening elements, which is obtained by adding the screening factors of the individual screening elements. This is applicable when the opaque regions provided in the different screening elements completely differ from each other in their arrangement, so that in the case of a superposition of the screening elements, the opaque regions of the individual screening elements do not overlap each other. If the individual screening elements are formed such that in the case of a superposition with other screening elements an overlap occurs between the opaque regions, the same must be considered correspondingly when calculating the total screening factor.

By superposition of the screening elements, different brightness levels can then be adjusted, wherein the screening elements can be formed such that screening can be varied linearly, for instance with brightness levels with a brightness of 0%-10%-. . . -100% of the maximum brightness of the light generated by the searchlight. It is also conceivable to form the screening elements such that a non-linear gradation, for instance a gradation modeling the brightness sensation-of the eye, is possible.

Exemplary, the screening elements of the dimming device are formed such that a complete screening of the light emitted by the searchlight is effected, when all screening elements of the dimming device are arranged in the region of the light emitted by the searchlight. In this case, the screening elements are superimposed such that the light is screened completely and a complete darkening of the adjusted light field occurs.

Exemplary, the screening elements representing masks are structured such that they each include regularly arranged opaque or partly transparent and transparent regions, by means of which the light impinging on a screening element is partly screened. Each mask can have a grid-like or raster-like structure, which is formed by the regularly arranged opaque and transparent regions. A fundamental aspect here consists in that a fine structure of the mask, for instance in the form of a fine grid or raster, effects a homogeneous influence on the light and thus a homogeneous light field. The finer the chosen structure of the mask, the more uniform the light distribution in the adjusted light field and the smaller the influence of the screening elements on the quality of the generated light field in terms of its homogeneity. By moving the mask into the light of the searchlight, a grey level thus is generated in principle in the brightness of the adjusted light field, whose intensity results from the area ratio of the opaque regions to the transparent regions of the mask. The larger the amount of opaque regions on the mask, the greater the screening of the light impinging on the mask and hence the reduction and dimming of the brightness of the light field generated. In principle, the screening element forming the mask can also be structured irregularly in this connection, i.e. in the form of structures non-uniformly distributed over the screening element. In this connection, it is decisive that each screening element is structured such that the generated light field adjusted by superposition of the screening elements is dimmed in the desired way and is sufficiently homogeneous.

It is also conceivable to form the screening element not as a grid-like mask, but as a grey, partly transparent disk with a uniform grey tone, which thus is not structured, but has a uniform grey tone. When superimposing such screening elements, the adjusted screening factor is not obtained by an addition, but by the multiplication of the individual screening factors. When transparent grey disks exclusively are provided, a complete darkening of the light field is not possible.

The dimming device can include both screening elements constituting grey disks and screening elements constituting structured masks, which can then be combined with each other for adjusting the brightness. The adjusted screening factor then results from the addition of the screening factors of the structured masks multiplied by the screening factor of the grey disks.

In addition, one or more different color elements can also be provided, which for coloring are moved into the light generated by the searchlight. By means of such color elements, color effects can then be produced or the color temperature can be corrected.

In an exemplary aspect, the dimming device constitutes a separate unit arranged in a housing, which for influencing the light emitted by a searchlight can be arranged for instance in the vicinity of a light outlet opening of the searchlight, through which the light generated by the searchlight leaves the searchlight. The dimming device thus constitutes a separate module, which is detachable from the searchlight and can be operated with different searchlights. In this connection it is also conceivable as an alternative that the dimming device is integrated in a searchlight, so that the dimming device is no separate unit and the screening elements inside the searchlight are moved into the light generated by the searchlight, in order to adjust the brightness of the light field generated.

Exemplary, the one or more screening elements of the dimming device are movably or swingably mounted about a swing axis in the dimming device. When the screening elements are movably mounted, they are brought into or removed from the region of the light emitted by the searchlight by shifting. When the screening elements are swingably mounted, it is conceivable to arrange the swing axis either vertical or parallel to the propagation direction of the light, so that for adjusting the brightness the screening elements are either folded into the region of the light from the left, from the right, from above or below—similar to wing doors of a searchlight—or are swung in a plane extending parallel to a light outlet opening of the searchlight.

Exemplary, a drive means then is provided for shifting or swinging the one or more screening elements, which in dependence on the brightness to be adjusted moves the screening elements into the region of the light emitted by the searchlight or removes the same from the region of the light emitted by the searchlight. In this way, the brightness of the light field generated can be varied incrementally by means of the dimming device, in that the desired screening factor and hence the desired brightness level is adjusted by combining the screening elements. The combination to be adjusted of the screening elements swung into the emitted light depends on the desired brightness of the light field, which results from the superposition of the individual screening elements and the screening factor adjusted thereby.

The drive means can be of the electromechanical type and include for instance an electric motor, by means of which the screening elements are moved into the light or removed from the light. Optionally, the electric motor can cooperate with a transmission and be connected with the screening elements for instance via a drive belt, a toothed belt or a cardan shaft. Instead of the electric motor, the drive means alternatively can also include bistable electromagnets for adjusting the screening elements, wherein one electromagnet each acts on a screening element and—depending on the condition of the electromagnet—brings the screening element into the light or removes the same from the light.

Furthermore, it can be provided to bias the screening elements by means of springs, in order to thus hold and fix the screening elements in their position in the dimming device.

In addition, the drive means can include an electronic control unit or cooperate with an external electronic control unit, by means of which a screening factor specified by a user is converted into a combination of screening elements to be used. The electronic control unit can be formed such that it stores an adjusted condition and restores the same automatically for instance after a power failure. The electronic control unit furthermore can be coupled with a bus system, in particular by using the DMX512 and CAN standards commonly used in systems for film and studio lighting, and with a light control desk via the bus system, so that a user can adjust the brightness of the searchlight via the light control desk. In this connection, a user then can also be enabled to read out the respective brightness adjusted and retrieve the operating condition of the dimming device.

In addition, it is also conceivable and advantageous to connect the dimming device with an electronic ballast via the electronic control unit and perform a control and fine adjustment of the searchlight via the electronic ballast. For instance, it is then possible that the coarse adjustment of the brightness is performed by the dimming device, whereas the fine adjustment is performed by the electronic ballast, so that a stepless control of the searchlight virtually is possible. Accordingly, a screening factor of 45% can for instance be adjusted by the screening elements and can then be fine-adjusted by the electronic ballast to a value of 47% by means of an additional screening of 2%.

Furthermore, the electronic control unit also can cooperate with a sensor for detecting the brightness of the adjusted light field, whose signal is used to automatically control and stabilize the brightness of the light field, or with a recording device, in particular a camera, which specifies the setpoints for the brightness to be adjusted.

In a further exemplary variant, the dimming device can also be connectable with an actuating rod, by means of which a user can mechanically adjust the brightness of the dimming device. Such actuating rods are expedient in particular when the dimming device is connected with a searchlight mounted on a rig at a great height above the ground, and are provided as a standard, in order to adjust the inclination and swing of searchlights. At the same time, the actuating rod then can also cooperate with the dimming device, for instance by using a so-called actuating bell, and can serve to adjust the brightness of the searchlight.

The one or more screening elements of the dimming device exemplary can constitute a metallic mask, whose opaque regions are formed by metallic surfaces. The metallic surfaces here can be formed for instance by a steel sheet or by aluminum vapor-deposited onto a glass disk. It is also conceivable here to provide the screening elements with a ceramic coating, in order to increase the heat resistance of the screening elements. Advantageously, the metallic mask is die-cut, embossed, drawn, lased, cast or injection-molded, wherein in particular the production of the mask by means of a laser can be effected precisely and at low cost. In a particularly simple and inexpensive variant, the screening elements can also constitute printed disks.

In principle, rigid glass or plastic disks, but also flexible films can be used for the screening elements. The use of films provides for a particularly space-saving construction of the dimming device, in that it can be provided to roll up the films, when they are not used, and to roll them out into the light for screening purposes. In addition, screening elements in the form of films can for instance also be arranged below the searchlight parallel to the searchlight housing, so as then to be moved about a searchlight edge into the region of the light outlet opening of the searchlight for screening purposes.

BRIEF DESCRIPTION OF THE DRAWINGS

The idea underlying the invention will be explained in detail below with reference to the embodiments illustrated in the Figures, in which:

FIG. 4A shows a first table listing the adjustable screening factors in dependence on the number of screening elements used for different embodiments of the screening elements.

FIG. 4B shows a second table listing the adjustable screening factors in dependence on the number of screening elements used for different embodiments of the screening elements.

FIG. 6 shows a table listing the screening factors adjustable by means of the combinations of the screening elements as shown in FIGS. 5A-5D.

DETAILED DESCRIPTION

Figure 1A:
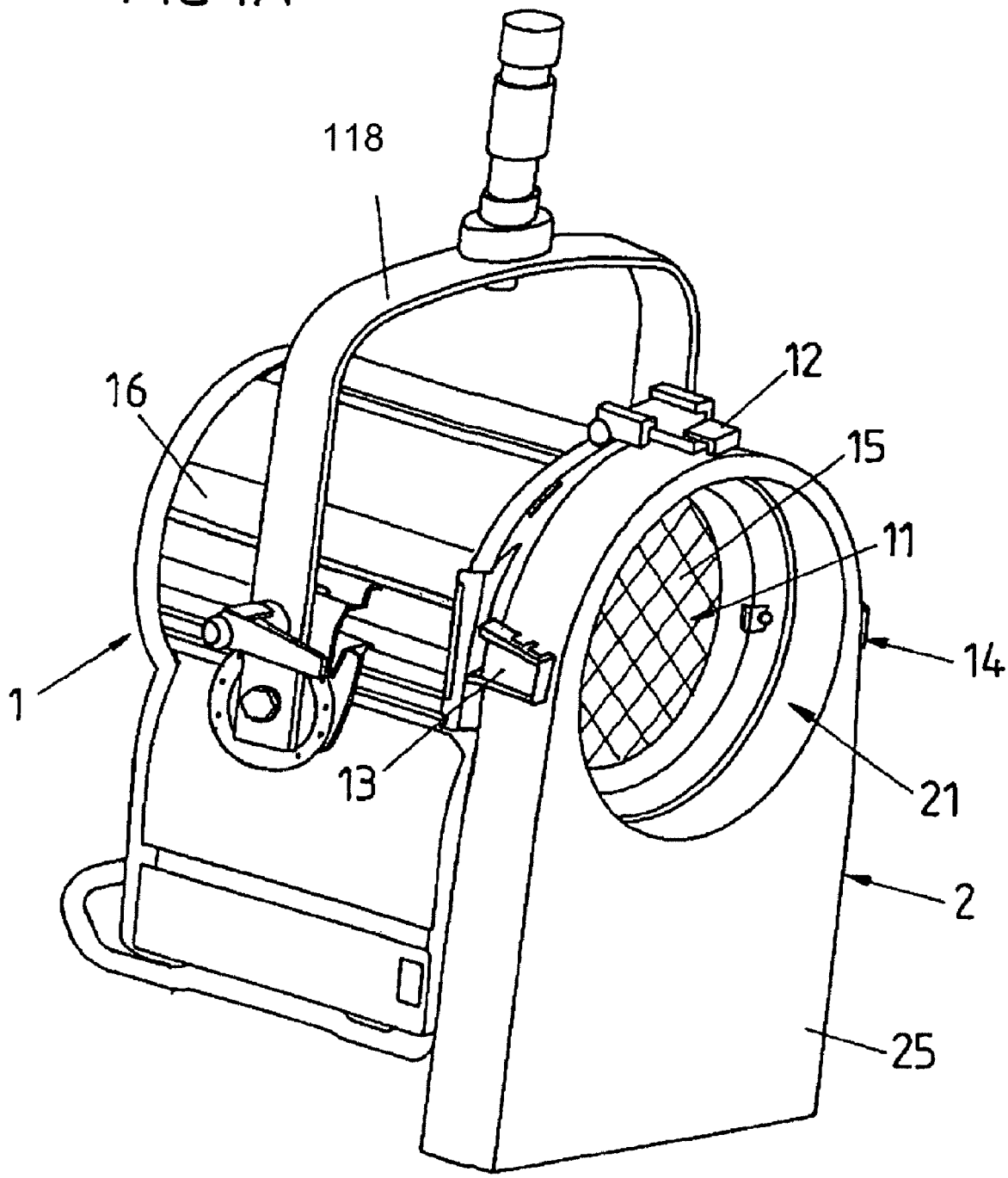
FIG. 1A shows a perspective view of a searchlight with a dimming device arranged in the vicinity of the light outlet opening of the searchlight.
Figure 1B:
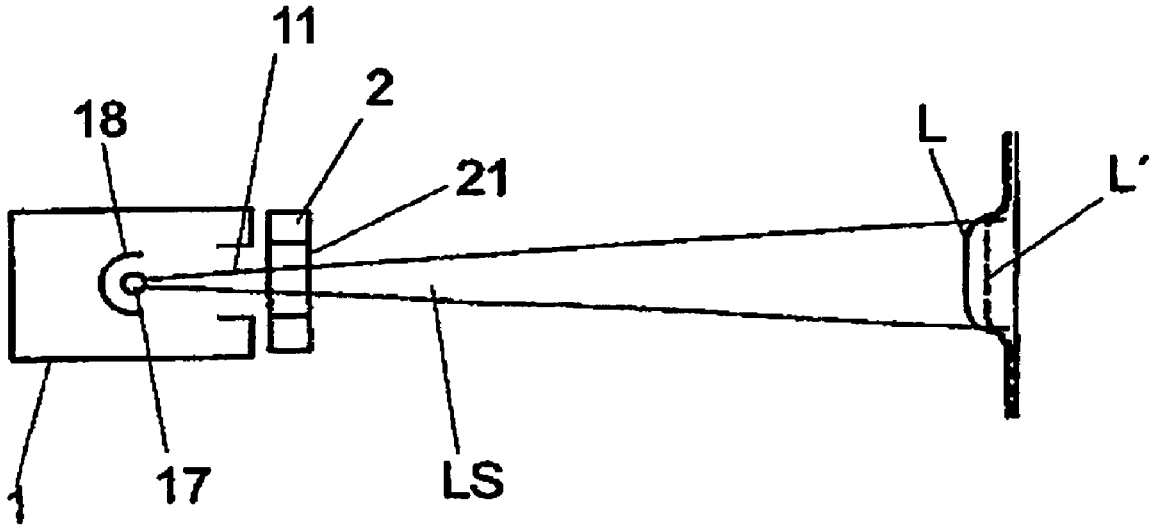
FIG. 1B shows a schematic cross-sectional view of a searchlight with a dimming device as shown in FIG. 1A.

FIG. 1A and FIG. 1B show a searchlight 1, which includes a lamp 17 which together with a reflector 18 is arranged in a searchlight housing 16 and in cooperation with the reflector 18 generates light LS and emits the same from the searchlight 1 through a light outlet opening 11, so as to form a light field L, L'. In general, the light LS is emitted by the searchlight 1 substantially conically, wherein the light cone comprising the light LS is defined by the so-called half-peak angle, which describes the scattering angle formed by the light cone. In this connection, the searchlight 1 in particular can be a studio searchlight for film or theater and can constitute a high-performance searchlight, in particular a ceramic or daylight searchlight. On the searchlight housing 16, a strap 118 is swingably mounted, by means of which the searchlight 1 can be attached to a rig, a stand or some other holding device.

This invention in particular relates to high-performance searchlights, which operate with a power in the kW range and cannot easily be dimmed by means of electronic ballasts. Therefore, such headlights conventionally employ mechanical dimming devices, by means of which the brightness of the light field L, L' generated by the searchlight 1 is adjustable, in that screening elements are arranged in the vicinity of the light outlet opening 11 of the searchlight and thus influence the brightness of the emitted light LF of the searchlight 1.

An essential quality characteristic of the light field L, L' generated by the searchlight 1 is the homogeneity of the light distribution, i.e. the uniform brightness in the region of the light field L, L'. Conventional dimming devices, for instance in the form of multiflap shutters, which are used for mechanically dimming the generated light field L, L', involve the disadvantage that they produce strips due to the formation of the lamellae and thus adversely influence the homogeneity of the adjusted light field L, L'. This problem is solved by the dimming device described below, which makes use of the idea underlying the invention and instead of lamellae employs screening elements with a fine-mesh structure or constituting grey disks.

In FIG. 1A and 1B, a dimming device 2 is arranged in the vicinity of the light outlet opening 11 of the searchlight 1 and connected with the searchlight 1 via holding claws 12, 13, 14, which in the vicinity of the light outlet opening 11 are mounted on the searchlight housing 16 or on an annular lens mount enclosing the light outlet opening 11. The dimming device 2 includes a housing 25, in which a through hole 21 for the light LS emitted by the searchlight 1 is arranged, wherein the light outlet opening 11 of the searchlight 1 and the through hole 21 of the dimming device 2 are arranged flush on top of each other, and thus the light LS emitted from the light outlet opening 11 completely gets into the region of the through hole 21 and passes the same. The light LS emitted by the searchlight 1 thus leaves the searchlight through the light outlet opening 11, passes through the through hole 21 of the dimming device 2 and generates a corresponding light field L, L'.

Figure 2:
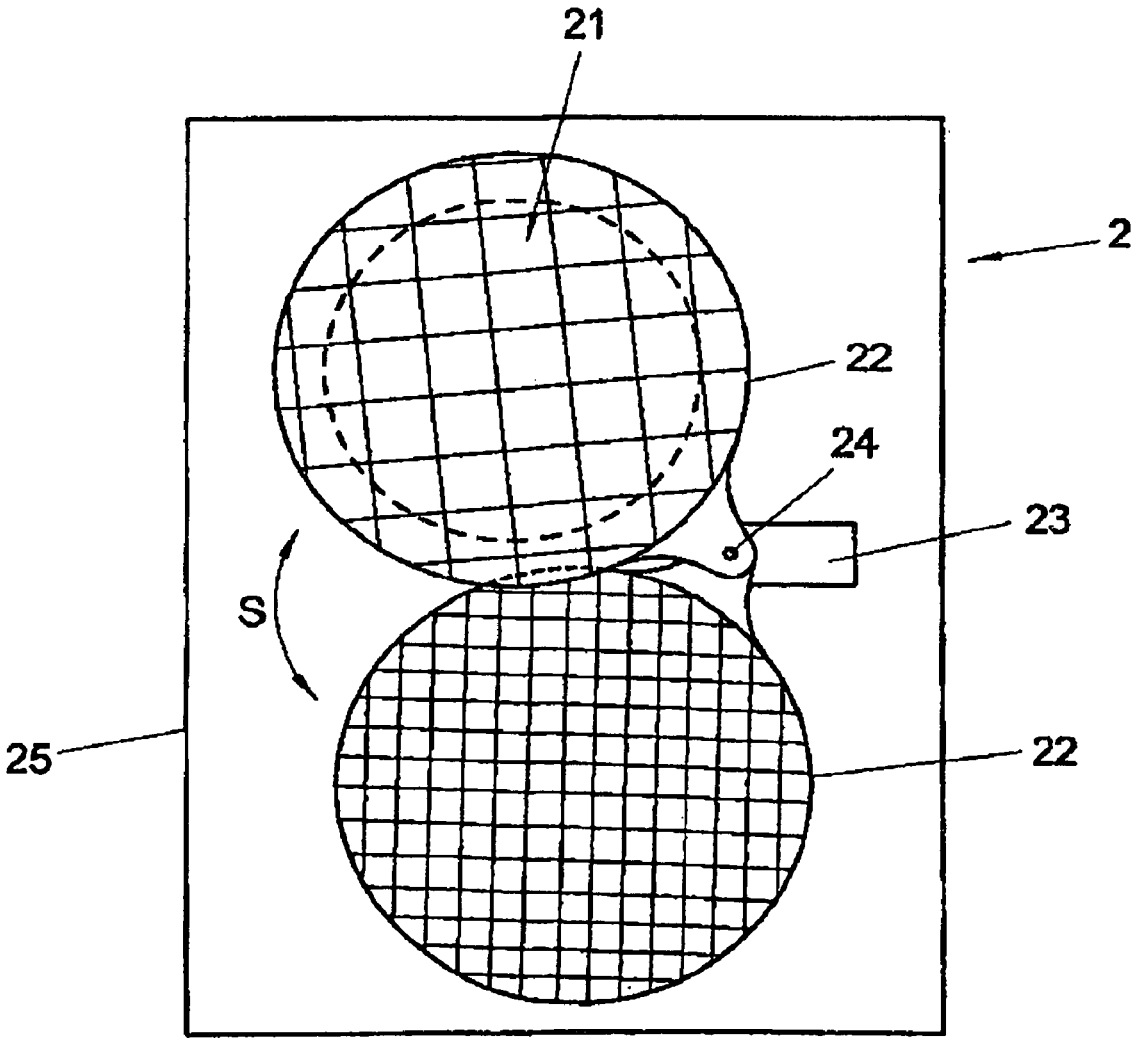
FIG. 2 shows a schematic partial sectional view of an embodiment of a dimming device.
Figure 3A:
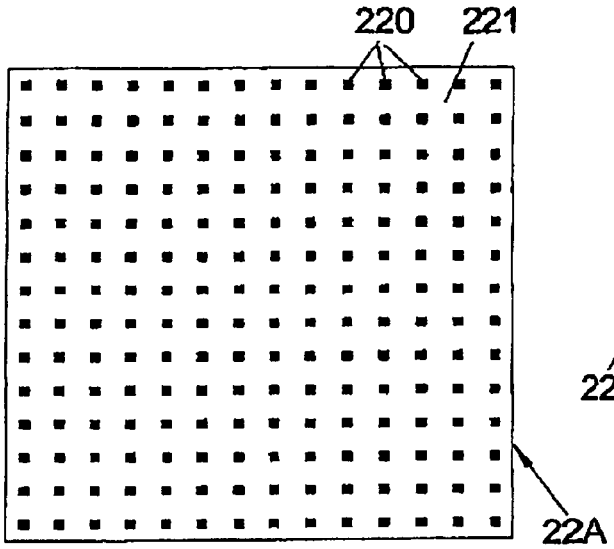
FIG. 3A shows a schematic representation of a first screening element constituting a mask.
Figure 3B:
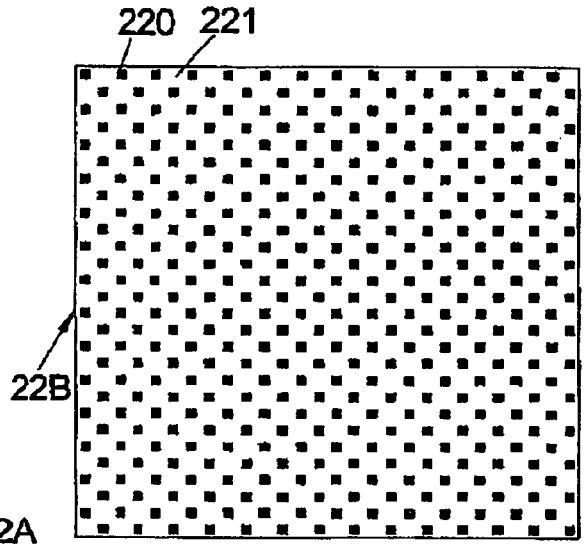
FIG. 3B shows a schematic representation of a second screening element constituting a mask.
Figure 3C:
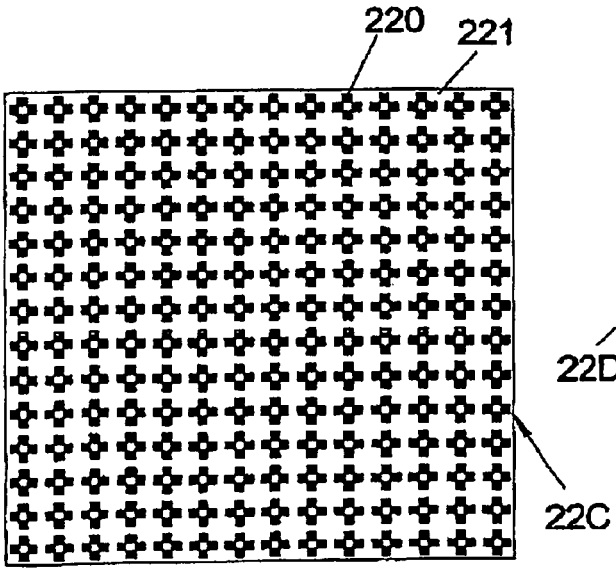
FIG. 3C shows a schematic representation of a third screening element constituting a mask.
Figure 3D:
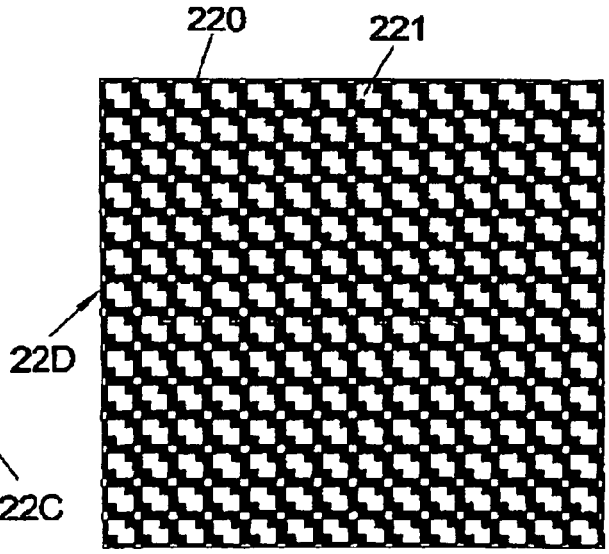
FIG. 3D shows a schematic representation of a fourth screening element constituting a mask.
Figure 5A:
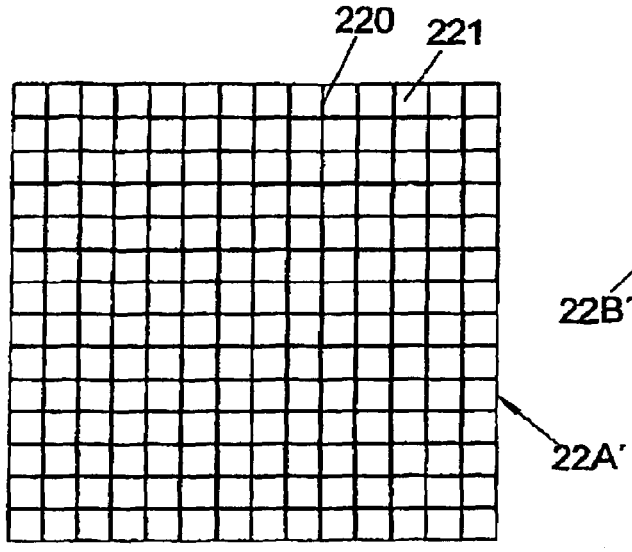
FIG. 5A shows a schematic representation of a first screening element constituting a mask for adjusting the screening factors as shown in FIG. 6.
Figure 5B:
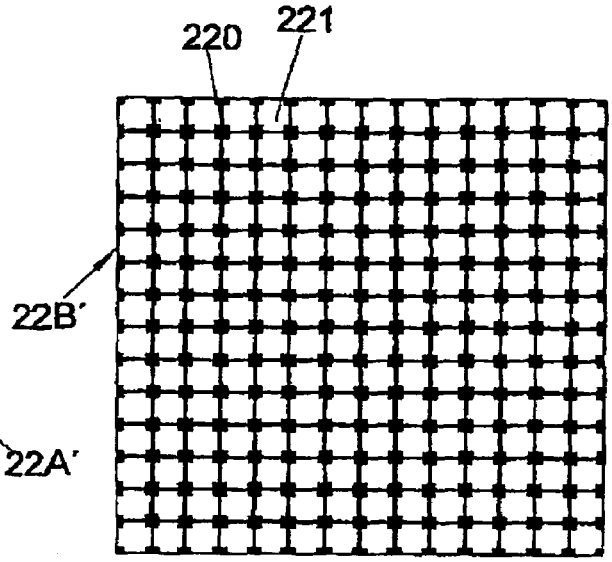
FIG. 5B shows a schematic representation of a second screening element constituting a mask for adjusting the screening factors as shown in FIG. 6.
Figure 5C:
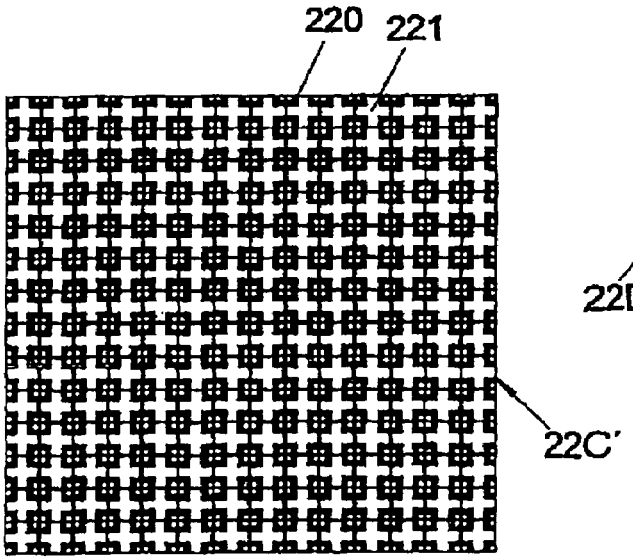
FIG. 5C shows a schematic representation of a third screening element constituting a mask for adjusting the screening factors as shown in FIG. 6.
Figure 5D:
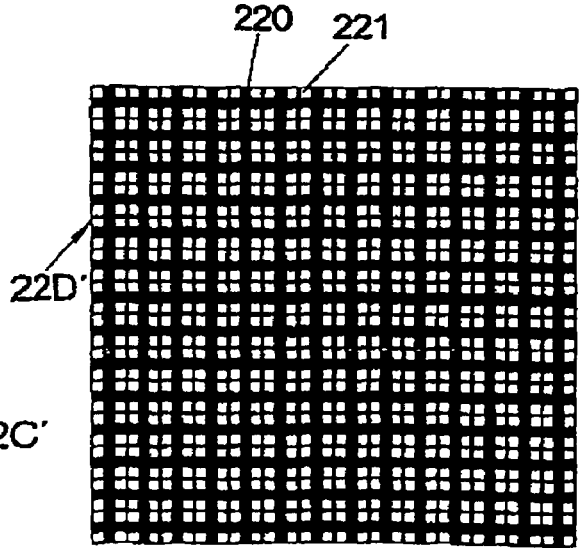
FIG. 5D shows a schematic representation of a fourth screening element constituting a mask for adjusting the screening factors as shown in FIG. 6.

The dimming device 2 is formed and provided to adjust the brightness of the light field L, L' generated by the searchlight 1 and thus dim it in the desired way. An embodiment of the dimming device 2 of the invention is illustrated in FIG. 2, which shows a partial sectional view of the dimming device 2 in the plane of the through hole 21. The dimming device 2 includes a plurality of screening elements 22, which are swingably mounted about a swing axis 24 in the dimming device 2. Furthermore, a drive means 23 is provided in the dimming device 2, by means of which the screening elements 22 can be swung from a lower position in the dimming device 2, in which they are not arranged in the vicinity of the through hole 21 and hence not in the vicinity of the light LS of the searchlight 1 passing through the through hole 21, into an upper position in a swing direction S, in order to cover the through hole 21 in this upper position such that the light emitted by the searchlight 1 and passing through the through hole 21 passes through the screening element 22 and is at least partly screened by the screening elements 22 arranged in the vicinity of the through hole 21.

The drive means 23 here can constitute for instance an electric motor with or without a transmission, which acts on the screening elements 22 via a shaft and moves the same. It is also conceivable that instead of the electric motor the drive means 23 includes bistable electromagnets, which in dependence on the switching condition swing the screening elements 22 into the upper or lower position, wherein the screening elements 22 can be biased by springs, in order to support swinging in one direction.

To influence the brightness of the light field L, L' generated by the searchlight 1, different screening elements 22 are moved into the region of the through hole 21, in order to screen the emitted light LS such that the desired brightness of the light field L, L' is adjusted. The maximum brightness of the light field L, L' is achieved when no screening element 22 is arranged in the vicinity of the through hole 21, so that all screening elements 22 are in the lower position outside the through hole 21, as shown in FIG. 2. The maximum screening of the light LS is achieved, however, when all screening elements 22 are brought into the region of the through hole 21 and the light LS thus is maximally screened and the light field L, L' is maximally darkened. As shown schematically in FIG. 1B, a brighter light field L thus is obtained with a weaker screening, whereas with a stronger screening by the screening elements 22 a correspondingly weaker light field L' is adjusted.

To adjust the brightness level of the dimming device 2, the drive means 23 can include an electronic control unit or cooperate with an external electronic control unit, which converts a user input for the brightness level to be adjusted into a suitable combination of screening elements 22 and thus controls the dimming device 2.

In principle, different embodiments are possible for the screening elements 22 as shown in FIG. 2. In particular, the screening elements 22 can have a grid-like or raster-like structure, wherein the screening adjustable by the individual screening elements is determined by the area ratio of the opaque regions to the transparent regions of the screening elements 22. The screening elements can be formed differently, so that incrementally different screenings can be adjusted by superposition of the individual screening elements.

The screening adjustable by the individual screening elements and the combination thereof can be characterized by a screening factor, which for each individual screening element 22 is obtained from the area ratio of opaque regions to the entire surface of the screening element 22. The adjusted total screening factor of a combination of screening elements 22 then is determined by the superposition of the individual screening elements 22. When the opaque screening regions of the individual screening elements 22 do not overlap in the case of a superposition of the screening elements 22, the total screening factor is obtained by addition of the screening factors of the individual screening elements. In the case of an at least partial overlap of the opaque regions of the individual screening elements, however, the area fraction of the overlapping regions must be deducted in the addition of the individual screening factors for determining the total screening factor.

In this connection, it is also conceivable to form the screening elements 22 as grey disks with a uniform grey tone. When using such grey disks, the screening factor then is not obtained by an addition, as in the structured disks, but by a multiplication of the screening factors of the individual screening elements 22. A combined use of both structured screening elements 22 and grey disks is also conceivable, wherein the total screening factor then is obtained by addition of the screening factors of the structured screening elements 22 and subsequent multiplication with the screening factors of the screening elements 22 constituting grey disks.

The formation of the screening elements 22 and the adjustment of the brightness of a light field by superposition of the screening elements 22 will be explained in detail below with reference to screening elements shown in FIG. 3A to 3D and the tables shown in FIGS. 4A and 4B.

FIG. 3A to 3D show four different screening elements 22A to 22D, which each have a raster-like, regularly distributed structure formed by transparent regions 221 and opaque regions 220. The screening to be achieved each by a screening element 22A to 22D can be described by the screening factor of the individual screening elements 22A to 22D, which indicates the area ratio of opaque regions 220 to the entire surface of a screening element 22A to 22D irradiated by the light LS of the searchlight 1 and thus the amount of light screened by the screening element 22A to 22D.

The first screening element 22A as shown in FIG. 4A has a screening factor of 1/16, due to the area fraction of the opaque regions 220 in the entire surface of 1/16 and the resulting screening of the light LS impinging on the screening element 22A by the opaque regions 220. In other words: with the screening element 22A, 1/16 of the light LS impinging on the screening element is screened. The screening elements 22B, 22C, 22D correspondingly have screening factors of 1/8 (screening element 22B), 1/4 (screening element 22C) and 1/2 (screening element 22D). The opaque surfaces 220 of the individual screening elements 22A to 22D are arranged such that with a superposition of the screening elements 22A to 22D—i.e. when the individual screening elements 22A are arranged one above the other in the vicinity of the through hole 21 of the dimming device 2—the opaque regions 220 of the screening elements 22A to 22D do not overlap, so that the screening factors of the individual screening elements 22A to 22D add up in the case of a superposition. When the screening element 22A and the screening element 22B are simultaneously brought into the region of the through hole 21 as shown in FIG. 2, so that they are superimposed and together have a screening effect on the light LS passing through the through hole 21, the total screening factor adjusted is 3/8, corresponding to the addition of the screening factors of the screening elements 22A, 22B. When all screening elements 22A to 22D are superimposed, i.e. brought into the region of the through hole 21, the screening factor is 15/16, corresponding to the value of the maximum adjustable darkening. In the embodiment of the screening elements 22A to 22D as shown in FIG. 3A to 3D, light LS still is transmitted through the screening elements 22A to 22D with maximum darkening, so that the brightness of the adjusted light field L, L' corresponds to a value of 1/16 of the maximum brightness.

In this connection, it is also conceivable to provide an additional screening element, which is completely opaque (screening factor 1) and, when swung into the through hole 21, effects a complete darkening of the searchlight 1.

Advantageously, the screening elements 22A to 22D are designed such that the screening factors of the individual screening elements 22A to 22D each are linked by multiples of the factor. In the embodiment shown in FIG. 3A to 3D, the screening factor of the screening element 22B accordingly corresponds to twice the screening factor of the screening element 22A. With such a configuration of the screening elements 22A to 22D, the screening factors of the individual screening elements then can be indicated by the relation $$\text{screening factor of the } i^{th} \text{ screening element} = 2^{i-1}/2^{N}$$

wherein N designates the total number of screening elements used. In four screening elements, the screening factor of the first screening element correspondingly is 1/16, of the second screening element 1/8, etc. If, however, a complete darkening, i.e. a screening factor 1, should be achieved with a superposition of all screening elements, the screening factors of the screening elements must be adapted or an additional screening element must be provided.

FIGS. 4A and 4B show two tables in which adjustable screening factors are listed in dependence on the number and type of screening elements used. In the individual columns, the following each is indicated:

in the first column, the number of screening elements used,
in the second column, the number of conditions adjustable with the
screening elements used, i.e. the number of the adjustable brightness
levels,
in column 3, the smallest incremental brightness level,
in column 4, the greatest adjustable screening factor, and
in columns 5-10, the screening factors of the individual screening
elements used.

The screening elements 22A to 22D as shown in FIG. 3A to 3D correspond to the case with four screening elements indicated in the table as shown in FIG. 4A (see line 4 of the table of FIG. 4A).

In the embodiments shown in FIG. 4A and FIG. 4B, the brightness of the light field L, L' can be adjusted between a maximum and a minimum value by superposition of the screening elements, wherein the maximum value corresponds to the brightness of the light LS maximally emitted by the searchlight 1 (corresponding to a screening 0) and the minimum value corresponds to a darkening by superposition of all screening elements used (corresponding to a screening with the maximum adjustable screening factor, see column 4 in FIGS. 4A and 4B). By each screening element, the brightness of the light field L, L' thus can incrementally be changed by a brightness level determined by the screening factor.

In the case shown in FIG. 4A, the screening elements are designed such that the maximum adjustable darkening is not complete (corresponding to the maximum adjustable screening factor indicated in column 4), so that even with a superposition of all screening elements used, a residual part of the light LS can pass through the screening elements. Here, it is advantageous that the greatest possible number of brightness levels can be adjusted for a used number of screening elements. In particular in the case shown in FIG. 4A, one screening element less is required with the same incremental brightness level (see column 3), when using more than two screening elements, as compared to the case of FIG. 4B.

The number of the adjustable conditions, i.e. the number of the different adjustable brightness levels, when forming the screening elements corresponding to FIG. 4A, is obtained from the formula $$Z=2^N,$$

wherein N describes the number of screening elements used, and Z describes the number of adjustable conditions. This applies to the case of FIG. 4A, in which a residual part of the light LS is transmitted with maximum darkening, so that no complete darkening is adjustable. The screening factors of the individual screening elements, which corresponding to FIG. 3A to 3D are adjusted by structuring the screening elements, each are indicated in columns 5 to 10 of FIG. 4A for different numbers of screening elements used.

In the case shown in FIG. 4B, on the other hand, the screening elements are formed such that with a superposition of all screening elements the light field is completely darkened, the brightness of the light field L, L' thus assumes the value zero (corresponding to the maximum screening factor of 1 according to column 4).

For the case shown in FIG. 4B, in which the screening elements are formed such that a complete darkening can be adjusted with a superposition of all screening elements, the number of adjustable conditions, i.e. the number of brightness levels, is obtained from $$Z=2^{(N-1)}+1,$$

wherein N in turn describes the number of screening elements used, and Z describes the number of adjustable conditions. The screening factors of the individual screening elements in turn are each indicated in columns 5 to 10 of FIG. 4B for different numbers of screening elements used.

Another embodiment of four different screening elements 22A' to 22D' is shown in FIG. 5A to 5D. The values of the screening factors adjustable by the screening elements 22A' to 22D' here correspond to ⅛ (screening element 22A'), ¼ (screening element 22B'), ⅜ (screening element 22C') and ⅝ (screening element 22B'). The possible combinations adjustable with the screening elements 22A' to 22D' shown in FIG. 5A to 5D and the resulting screening factors are listed in the table of FIG. 6, wherein,

- line 1 indicates the adjusted brightness level for the different combinations of screening elements 22A' to 22D',
- line 2 indicates the adjusted screening factor,
- line 3 indicates the adjusted transmission, corresponding to a value of 1 minus the adjusted screening factor, and
- lines 4 to 7 indicate the screening elements 22A' to 22D' used for a respective combination, wherein an x indicates the use of a screening element 22A' to 22D'.

In the screening elements shown in FIG. 5A to 5D there is the particularity that the screening element 22A' is integrated in the screening elements 22B' to 22D', in that the grid-like structure of the screening element 22A' is also realized in the screening elements 22B' to 22D'. As indicated in FIG. 6 by the (x) put in brackets, the screening element 22A' therefore is only used for adjusting the second brightness level, corresponding to a screening factor of ⅛. For adjusting the brightness levels 3-9, the screening elements 22B'-22D' merely are combined with each other in the way shown in FIG. 6, wherein a screening element used for a combination each is designated by an x in FIG. 6. When combining the screening elements 22B'-22D', the maximum adjustable darkening corresponds to a screening factor of 1, so that with a maximum darkening no more light LS can get through the superimposed screening elements 22B'-22D' and the brightness of the light field L, L' generated thus is zero.

It is an advantage of the screening elements 22A' to 22D' of FIG. 5A to 5D that the screening elements can easily be fabricated by structuring a sheet metal with a laser. For this purpose, all screening elements 22A' to 22D' must have a grid-like structure, which in the screening elements 22A' to 22D' is realized in that the grid of the screening element 22A' is also formed in the other screening elements 22B' to 22D'.

In principle, any division between opaque regions and transparent regions can be chosen in the screening elements 22A-22D and 22A'-22D' of FIG. 3A-3D and FIG. 5A-5D, respectively. Actually, the smaller the chosen raster, the more homogeneous the adjusted light distribution of the light field L, L'. The dimming device 2 is independent of the half-peak angle of the light LS emitted by the searchlight 1, since the dimming device 2 merely acts on the brightness of the light field L, L' generated.

When forming the screening elements, it may be advantageous to make the screening factor not homogeneous over a screening element, but to vary the screening factor over the screening element. In particular with greater half-peak angles of a search light, i.e. with an expanded light field, and when using screening elements with a comparatively great thickness, an oblique incidence of light in the outer regions of the screening elements may lead to the light field generated being adversely influenced, in particular to parasitic patterns in the light field or to a shadow in the central region of the light field. This problem can be solved in that the screening elements are adapted corresponding to their position in the path of the light by expanding them in their respective outer regions, i.e. in the outer regions of each screening element away from the center. The expansion for the rear screening elements, i.e. for those screening elements through which the light passes last, should be chosen greater than for the front screening elements. In principle, it thus is considered that a screening element arranged further to the rear in the light cone must be formed wider both in its structure and in its total surface corresponding to the greater surface irradiated than a screening element arranged further to the front and closer to the lamp. The structures of the screening elements then are slightly offset relative to each other corresponding to the conical propagation of the light and each are expanded to the outside.

An essential advantage of the presented dimming device 2 consists in that an incremental adjustment of the brightness of the light field L, L' generated is mechanically made possible in a wide range with a simple construction and little space requirement of the dimming device 2. As shown in FIGS. 4A and 4B, the incremental size of the adjustable brightness levels is dependent on the number of screening elements used, and is the smaller the more screening elements are used.

In particular, the screening elements 22A-22D, 22A'-22D', 22 can be formed by a metallic mask, wherein the mask can be formed for instance by a stainless steel sheet or a glass disk vapor-coated with aluminum and advantageously is manufactured in a simple and inexpensive way by processing with a laser. The structuring of the mask advantageously is chosen such that processing with a laser is easily possible and shapes which cannot be produced with a laser, or only with difficulty, thus are avoided. In this connection, as shown in FIG. 3A-3D and FIG. 5A-5D, structuring the mask in particular is effected by using angular or square shapes, so that round shapes, which are difficult to produce with a laser, are avoided.

Entirely different types of screening elements, which make use of the idea underlying the invention, are conceivable. In particular, it is conceivable to irregularly structure the screening elements, in that—contrary to the embodiments shown in FIG. 3A to 3D and 5A to 5D—just no regular grid structure is used. Here, it is essential that the screening elements have a screening effect on the light generated by a searchlight and the brightness of the light field generated is incrementally adjustable by superposition of the screening elements.

The invention claimed is:

1. A dimming device for a searchlight for adjusting a brightness of a light field generated by the searchlight said dimming device comprising a plurality of different screening elements which are formed and provided to partly or completely screen a light emitted by the searchlight, wherein the screening elements are formed by different structured masks at least partly screening the light emitted by the searchlight and which include regularly arranged opaque or partly transparent regions and transparent regions, and means provided for incremental adjustment of the brightness of the generated light field of the searchlight either to bring the screening elements into a region of the light emitted by the searchlight in order to reduce the brightness of the light field generated by one brightness level, or to remove the same from the region of the light emitted by the searchlight in order to increase the brightness of the light field generated by one brightness level.

2. The dimming device of claim 1, wherein different screening elements are formed and provided to adjust different brightness levels of the light field generated by superposition of the different screening elements.

3. The dimming device of claim 2, wherein each screening element is characterized by a screening factor indicating the amount of light screened off, wherein a total screening factor of the superimposed screening elements is obtained by addition of the screening factors of the superimposed screening elements.

4. The dimming device of claim 2, wherein the light emitted by the searchlight is completely screened off when the different screening elements all are arranged in the region of the light emitted by the searchlight.

5. The dimming device of claim 1, wherein the screening elements comprise a mask each having a grid-like or raster-like structure formed by the opaque or partly transparent and transparent regions.

6. The dimming device of claim 1, wherein the screening elements comprise a mask each comprising a grey disk which partly transmits the light emitted by the searchlight.

7. The dimming device of claim 1, comprising a plurality of screening elements which include regularly arranged opaque or partly transparent regions and transparent regions, and at least one screening element which constitutes a grey disk, wherein different brightness levels are adjustable by superposition of the screening elements.

8. The dimming device of claim 1, wherein in addition a color element is provided for coloring the light emitted by the searchlight.

9. The dimming device of claim 1, wherein the dimming device forms a separate unit arranged in a housing.

10. The dimming device of claim 1, wherein screening elements are movably or swingably mounted about a swing axis on the dimming device.

11. The dimming device of claim 10, wherein the swing axis of the swingably mounted screening elements is arranged substantially vertical or parallel to a propagation direction of the light emitted by the searchlight.

12. The dimming device of claim 1, wherein a drive means is provided for shifting or swinging the screening elements, in order to bring the screening elements into a region of the light emitted by the searchlight or remove the same from the region of the light emitted by the searchlight.

13. The dimming device of claim 12, wherein the drive means includes an electric motor.

14. The dimming device of claim 12, wherein the drive means is formed to swing the screening elements by means of an electromagnet.

15. The dimming device of claim 1. wherein the screening elements are biased by a spring.

16. The dimming device of claim 12, wherein the drive means includes an electronic control unit, which converts a screening factor specified by a user into a combination of different screening elements for adjusting the screening factor.

17. The dimming device of claim 16, wherein the electronic control unit is formed and provided to cooperate with an electronic ballast of the searchlight for fine adjustment of the brightness of the light field of the searchlight.

18. The dimming device claim 16, wherein the electronic control unit is formed and provided to cooperate with a sensor which measures the brightness of the light field generated for controlling the brightness of the light field generated.

19. The dimming device of claim 16, wherein the electronic control unit is formed and provided to cooperate with a recording device, in particular a camera, for adjusting the brightness of the light field generated.

20. The dimming device of claim 1, wherein the dimming device is connectable with an actuating rod for adjusting the brightness of the light field generated.

21. The dimming device of preceding claim 1, wherein the screening elements constitute comprise metallic masks whose opaque regions are formed by metallic surfaces.

22. The dimming device of claim 1, wherein the metallic masks are die-cut, embossed, drawn, lased, cast or injection-molded.

23. The dimming device of claim 1, wherein the screening elements comprise a printed disk.

24. The dimming device of claim 1, wherein the screening elements comprise a glass or plastic disk or a film.

25. A searchlight with a dimming device for a searchlight for adjusting a brightness of a light field generated by the searchlight, said dimming device comprising a plurality of different screening elements which are formed and provided to partly or completely screen a light emitted by the searchlight, wherein the screening elements are formed by different structured masks at least partly screening the light emitted by the searchlight which include regularly arranged opaque or partly transparent regions and transparent regions, and means for incremental adjustment of the brightness of the generated light field of the searchlight either to bring the screening elements into the region of the light emitted by the searchlight in order to reduce the brightness of the light field generated by one brightness level, or to remove the same from the region of the light emitted by the searchlight in order to increase the brightness of the light field generated by one brightness level.

26. A dimming device for a searchlight for adjusting a brightness of a light field generated by the searchlight, said dimming device comprising a plurality of different screening elements which are formed and provided to partly or completely screen a light emitted by the searchlight, wherein the screening elements are formed by different structured masks at least partly screening the light emitted by the searchlight and which include regularly arranged opaque or partly transparent regions and transparent regions, and an adjustor incrementally adjusting the brightness of the generated light field of the searchlight either to bring the screening elements into a region of the light emitted by the searchlight in order to reduce the brightness of the light field generated by one brightness level, or to remove the same from the region of the light emitted by the searchlight in order to increase the brightness of the light field generated by one brightness level.

27. A searchlight with a dimming device for a searchlight for adjusting a brightness of a light field generated by the searchlight, said dimming device comprising a plurality of different screening elements which are formed and provided to partly or completely screen a light emitted by the searchlight, wherein the screening elements are formed by different structured masks at least partly screening the light emitted by the searchlight which include regularly arranged opaque or partly transparent regions and transparent regions, and an adjustor incrementally adjusting the brightness of the generated light field of the searchlight either to bring the screening elements into the region of the light emitted by the searchlight in order to reduce the brightness of the light field generated by one brightness level, or to remove the same from the region of the light emitted by the searchlight in order to increase the brightness of the light field generated by one brightness level.

* * * * *

UNITED STATES PATENT AND TRADEMARK OFFICE

CERTIFICATE OF CORRECTION

PATENT NO. : 7,862,208 B2
APPLICATION NO. : 12/226811
DATED : January 4, 2011
INVENTOR(S) : Erwin Melzner It is certified that error appears in the above-identified patent and that said Letters Patent is hereby corrected as shown below:

In the Claims

| | |
|---|---|
| Column 14, Claim 15, line 23 | Delete "claim 1."<br>Insert -- claim 1, -- |
| Column 14, Claim 18, line 34 | After "device"<br>Insert -- of -- |
| Column 14, Claim 21, line 46 | Delete "constitute" |

Signed and Sealed this
Fifteenth Day of November, 2011

David J. Kappos

David J. Kappos
*Director of the United States Patent and Trademark Office*